US006411786B2

(12) United States Patent
Yokosuka et al.

(10) Patent No.: US 6,411,786 B2
(45) Date of Patent: Jun. 25, 2002

(54) TONER IMAGE FIXING DEVICE USING A PARKING AGENT INCLUDING A VOLATILE ODOR COMPONENT

(75) Inventors: Michio Yokosuka; Teruaki Mitsuya, both of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/727,763

(22) Filed: Dec. 4, 2000

(30) Foreign Application Priority Data

Dec. 3, 1999 (JP) ..... 11-344300

(51) Int. Cl.[7] ..... G03G 15/20
(52) U.S. Cl. ..... 399/69; 399/324; 399/98
(58) Field of Search ..... 399/67, 69, 91, 399/98, 320, 324, 328, 329, 330

(56) References Cited

U.S. PATENT DOCUMENTS 4,943,831 A * 7/1990 Geraets et al. ..... 399/328 X
5,619,315 A * 4/1997 Kusumoto et al. ..... 399/324
5,623,331 A * 4/1997 Kaneko et al.
5,652,949 A * 7/1997 Ogawa et al. ..... 399/69
RE35,923 E * 10/1998 Mitsuya ..... 399/330
5,950,060 A * 9/1999 Isogai ..... 399/324
5,983,048 A * 11/1999 Moser ..... 399/67
5,991,564 A * 11/1999 Ni ..... 399/69

OTHER PUBLICATIONS

"Progress and Results of Deodorization Technology", (p. 147–148), published Jan. 31, 1991 by Comprehensive Technical Center Corp.

* cited by examiner

*Primary Examiner*—Sandra Brase
(74) *Attorney, Agent, or Firm*—Sughrue Mion, PLLC

(57) ABSTRACT

A toner image fixing device in which a surface temperature of a heat roller (1) is set to a temperature at which volatile odor component included in a parting agent is below a permissible value, and in which an auxiliary heating means (9, 10) is provided on at least one side of the upstream side and the downstream side in a recording material transporting direction in relation to a pressure contact portion of the heat roller and a pressure (5).

6 Claims, 1 Drawing Sheet

TONER IMAGE FIXING DEVICE USING A PARKING AGENT INCLUDING A VOLATILE ODOR COMPONENT

BACKGROUND OF THE INVENTION

1. Field of the Invention

The invention relates to a toner image fixing device for fixing onto the recording material an unfixed toner image formed on recording material.

2. Description of the Related Art

In an image forming apparatus such as an electrophotographic copying machine, a printer and the like, as a toner image fixing device for fixing onto the recording material an unfixed toner image formed on recording material, so-called a heat roller system toner image fixing device is generally known and spread, which comprises a heat roller and a pressure roller that comes into pressure contact with the heat roller.

In the heat roller system toner image fixing device of this kind, in order to prevent toner offset, a parting agent is supplied onto a surface of the heat roller, so that such consideration is given that fixing quality of the toner image can be maintained.

Incidentally, in oils used as the parting agent, there is oil having volatile odor component. Mercaptan denatured silicon oil is representative of the oils used as the parting agent.

Though the mercaptan denatured silicon oil is superior in parting ability and heat stability, in case that the mercaptan denatured silicon oil is used under a temperature environment of about 170° C. and more, an offensive odor is emitted in the surroundings, which gives an unpleasant feeling to a worker who is working there.

In spite of the generation of the above offensive odor, in the conventional toner image fixing device, surface temperature of the heat roller is generally set to 190° C. and more. Therefore, careful consideration in relation to the problem of the offensive odor was not given.

Here, in case that the mercaptan denatured silicon oil of the predetermined capacity has been left as it is for twenty-four hours under the temperature environment of 190° C., the volatile odor component of 0.5% and more in relation to the above predetermined capacity is generated. The value of "0.5% and more" corresponds to a rank of −3 (very unpleasant) in pleasure/unpleasure degree display of nine ranks according to an evaluation method of odor in "Progress and Results of Deodorization Technology" (P147) published by Comprehensive Technical Center Corp.

SUMMARY OF THE INVENTION

An object of the invention is to provide a toner image fixing device that can fix a toner image onto recording material very well by suppressing generation of a volatile odor component included in a parting agent without emitting an offensive odor in the surroundings an image forming apparatus , even if the parting agent including the volatile odor component is used.

In order to achieve the above object, a toner image fixing device comprises:

a first roller having a heater lamp provided therein;

a second roller coming into pressure contact with the first roller at a pressure contact portion;

a parting agent supplying unit adapted to supply a parting agent having a volatile odor component onto a surface of the first roller; and an auxiliary heating unit provided on at least one side of an upstream side and a downstream side in a recording material transporting direction in relation to the pressure contact portion, wherein a recording material having unfixed toner on a front surface thereof is heated and pressed at the pressure contact portion while being nipped and conveyed at the pressure contact portion, thereby fixing the unfixed toner onto the recording material; and a surface temperature of the first roller is set to a temperature at which the volatile odor component has no more than a permissible value.

DETAILED DESCRIPTION OF THE PREFERRED EMBODIMENTS

Figure 1:
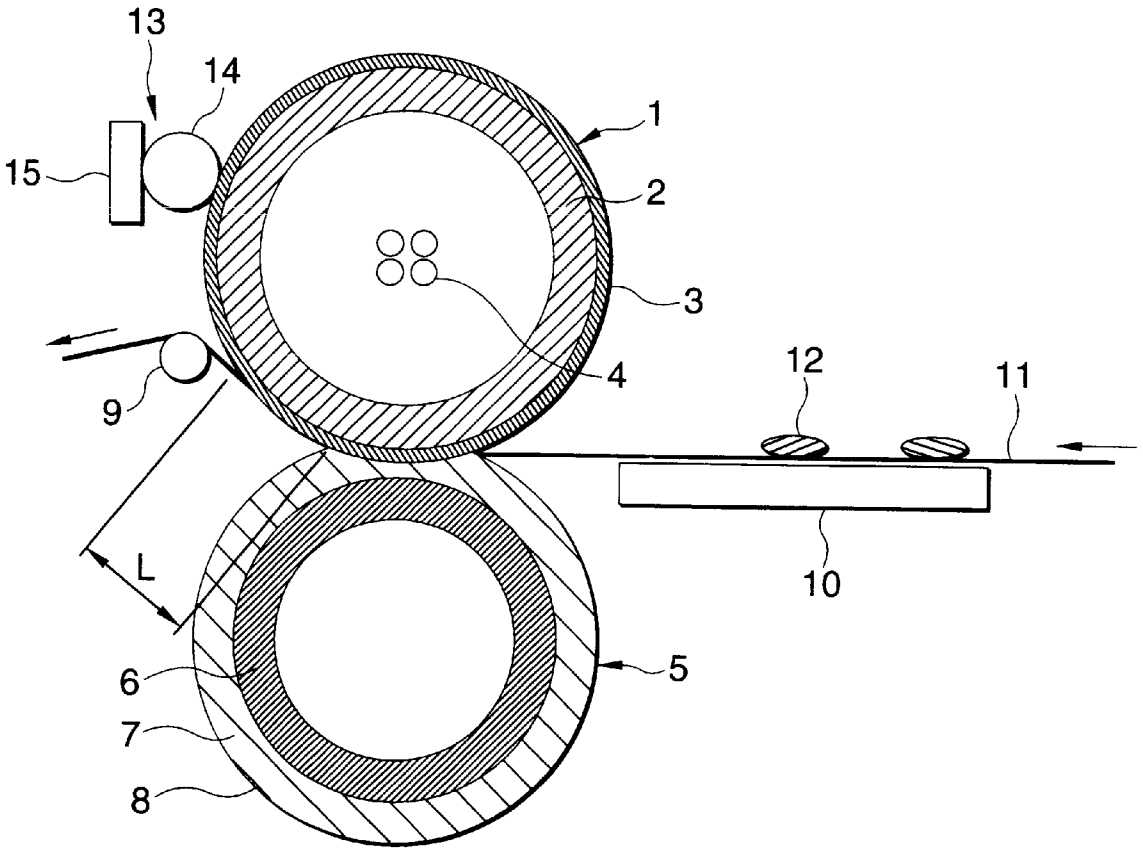
FIG. 1 is a schematic diagram showing one embodiment of the invention.

An embodiment of the invention will be described below with reference to drawings.

FIG. 1, numeral 1 denotes a heat roller, and numeral 5 denotes a pressure roller coming into pressure contact with the heat roller 1.

The heat roller 1 comprises a cylindrical metal core 2 made of, for example, aluminum, an elastic layer 3 provided on the metal core 2, and heater lamp 4 provided within the metal core 2. In this embodiment, the elastic layer 3 uses fluororubber that is superior in wear-resistance and swelling-resistance to the parting agent (silicon oil) Further, thickness of the elastic layer 3 on the metal core 2 is within a range from 0.1 mm and more to 0.3 mm and less.

A plurality of the heater lamps 4 (in this embodiment, four heater lamps) provided within the core metal 2 perform ON/OFF control in order to keep the surface temperature of the heat roller 1 constant. Further, a known temperature control where a temperature sensor detects the surface temperature of the heat roller and feedback control is performed on the basis of the detection value, is applied to the ON/OFF control of the heater lamp. Detailed description is omitted.

Further, the pressure roller 5 comprises a cylindrical metal core 6 made of, for example, aluminum, an elastic layer 7 provided on the metal core 6, and a resin layer 8 provided on the elastic layer 7. In this embodiment, the elastic layer 7 is composed of a silicon rubber, and the resin layer 8 is composed of PFA. Further, in addition to PFA, FEP may be used as the resin layer 8.

In order to prevent toner offset onto the surface of the heat roller 1, an oil supplying device 13 for supplying a parting agent is provided in the vicinity of the heat roller 1. The oil supplying device 13 comprises, for example, an oil supply roller 14 provided so as to come into contact with the surface of the heat roller 1; an oil impregnation pad 15 coming into contact with a backside of the oil supply roller 14; and an oil supply portion (not shown) for supplying silicon oil to the oil impregnation pad 15.

Here, in order to use oil having volatile odor component such as mercaptan denatured silicon oil as the parting agent, the surface temperature of the heat roller 1 must be regulated in such a manner that the odor component is not volatilized. However, if the surface temperature of the heat roller is set to a low temperature (for example, about 150° C. to 170° C.) in order to suppress the volatilization of the odor component, there are produced some cases where the unfixed toner image cannot be fixed completely onto the recording material. Particularly, in an image forming apparatus where high-speed printing is performed at a printing speed of 200 sec. and more, it is difficult to perform the sufficient fixing at only pressure contact portion of the heat roller 1 and pressure roller 5 at the above fixing temperature.

Therefore, in the invention, the surface temperature of the heat roller 1 is set to a comparatively low temperature at which the volatile odor component becomes below a permissible value, and heat of shortage is supplied by an auxiliary heating means provided on at least one side of the upstream side and the downstream side in a recording material transporting direction in relation to the pressure contact portion of the heat roller 1 and pressure roller 5.

Here, as the auxiliary heating means, as shown in FIG. 1, there are provided a heating means of reference numeral 10 heating a back surface of recording material 11, and a winding means of reference numeral 9 winding the recording material 11 on the surface of the heat roller 1 by predetermined distance L.

The heating means 10 is, for example, a preheating plate having a heat generator (not shown) therein, and the winding means 9 is, for example, a guide roller provided so that the winding means 9 can come into contact with or separate from the surface of the heat roller 1.

The toner image fixing device having the above constitution was mounted on a high-speed laser printer having printing speed of 800 mm/sec., and evaluation test relating to the odor of the oil and the image quality was performed.

The recording material 11 carrying the unfixed toner image 12, which has been fed to the fixing portion, is heated up to about 90° C. by the preheating plate 10 before entering the pressure contact portion of the heat roller 1 and pressure roller 5. Thereafter, the recording material 11 is heated and pressed at the pressure-contact portion of which the temperature is controlled so as to be about 160° C., and fed out from the heat roller 1 and pressure roller 5. However, after the recording material 11 passed the pressure-contact portion, heating is also continued while the recording material 11 is being wound on the heat roller 1 by the guide roller 9. Here, it is preferably that the wound distance L by the guide roller 9 is about 30 to 70 mm. In this embodiment, the wound distance L was set to 50 mm. Namely, in case that L is shorter than 30 mm, the heating time becomes short, so that there is a tendency for the fixing strength to be insufficient. Further, in case that L is longer than 70 mm, the heating time becomes long, so that image batter is frequently produced.

Further, by controlling the heat generator within the preheating plate 10, the surface temperature of the recording material is controlled so as to be 70° C. to 90° C. just before the recording material 11 enters the pressure contact portion.

In the fixing process performed under the above constitution, the unfixed toner image 12 formed onto the recording material 11 passes on the preheating plate 10, thereby the unfixed toner image 2 becomes a state just before being soft. At the next pressure-contact portion, the tomer image becomes a temporary fixing state. While the recording material 11 that has come out from the pressure-contact portion is passing the wound region formed by the guide roller 9, the heat is transmitted from the heat roller 1 to the toner, whereby a real fixing is performed, and a tomer image which having high fixing strength and being small in batter is obtained.

Table 1 shows a comparison result of the evaluation test.

TABLE 1

| Surface Temperature of Heat Roller (° C.) | Surface Temperature of Recording Material Heated by Preheating Plate (° C.) | Wound Distance by Guide Roller (mm) | Unpleasure by Oil Odor | Image Quality |
|---|---|---|---|---|
| 190 | 60 | 10 | −2 rank (Unpleasure) | Insufficient fixing Strength |
| | | 50 | | |
| | | 90 | | |
| | 90 | 10 | | |
| | | 50 | | |
| | | 90 | | |
| | 120 | 10 | | Image batter |
| | | 50 | | |
| | | 90 | | |
| 0160 | 60 | 10 | 0 rank (Neither pleasure nor unpleasure) | Insufficient fixing Strength |
| | | 50 | | |
| | | 90 | | |
| | 90 | 10 | | Precise image |
| | | 50 | | Image batter |
| | | 90 | | |
| | 120 | 10 | | |
| | | 50 | | |
| | | 90 | | |
| 140 | 60 | 10 | 0 rank (Neither pleasure nor unpleasure) | Insufficient fixing Strength |
| | | 50 | | |
| | | 90 | | |
| | 90 | 10 | | |
| | | 50 | | |
| | | 90 | | |
| | 120 | 10 | | |
| | | 50 | | |
| | | 90 | | |

In the evaluation test, numerical values in items of surface temperature of heat roller 1, surface temperature of recording material 11 heated by preheating plate 10, and wound distance by guide roller 9 were changed, and in relation to each numerical value, odor of oil and image quality were investigated.

As a result, when the surface temperature of the heat roller 1 was set to 190° C., the displeasure given by the odor of the oil was −2 rank (displeasure) according to "pleasure/displeasure degree display of nine ranks" ("Progress and Results of Deodorization Technology" referring to P147 published by Comprehensive Technical Center Corp.). Further, regarding the image quality, the fixing strength was insufficient and the image batter was produced, so that a fixing device in this case was not suitable for the practical use. Incidentally, an evaluation of the odor of the oil was determined as follows. Ten experimental subjects confirmed the odor of the oil at a position being 20 cm apart from an exhaust fan provided at the neighborhood of the toner image fixing apparatus in the laser printer to rank the odor of the oil based on the above described pleasure/displeasure degree display represented by the nine ranks. Then displeasure degree ranked by a major of subjects was applied for the evaluation of the odor of the oil.

Further, when the surface temperature of the heat roller 1 was set to 140° C., the displeasure due to the odor of the oil was improved up to 0 rank (neither pleasure nor displeasure). However, regarding the image quality, the fixing strength has been insufficient yet, so that a fixing device in this case was not suitable for the practical use.

On the other hand, when the surface temperature of the heat roller 1 was set to 160° C., the unpleasure due to the odor of the oil was 0 rank (neither pleasure nor unpleasure). Further, regarding the image quality, an image of high preciseness was obtained in case that the surface temperature of the recording material 11 was heated up to about 90° C. by the preheating plate 10 and the wound distance by the guide roller 9 was set to 50 mm.

Further as the parting agent, the mercaptan denatured silicon oil was adopted. However, the volatile component having the offensive odor in the oil was difficult to be generated, that is, it could be suppressed so as to be [0.5% and less], since the surface temperature of the heat roller 1 was set to about 160° C. which is low for the toner image fixing.

This embodiment has been described on the basis of the constitution where the preheating plate 11 is provided as the auxiliary heating means on the upstream side in the recording material transporting direction in relation to the pressure contact portion and the guide roller 9 is provided as the auxiliary heating means on the downstream side in the recording material transporting direction in relation to the pressure contact portion. However, according to the parting agent that is used and the printing speed, only any one of the preheating plate and the guide roller may be used.

Further, on the contrary to the above constitution, the guide roller may be provided on the upstream side in the recording material transporting direction in relation to the pressure contact portion, and the preheating plate may be provided on the downstream side in the recording material transporting direction in relation to the pressure contact portion.

Further, the auxiliary heating means is not limited to the above-described preheating plate and guide roller. For example, it may be a heater that heats the recording material from the surface thereof carrying the toner image.

As described above, according to the invention, there can be provided a toner image fixing device capable of fixing a toner image onto recording material very well by suppressing generation of volatile odor component included in the parting agent without emitting an offensive odor in the surroundings of an image forming apparatus, even if the parting agent comprising the volatile odor component is used.

What is claimed is:

1. A toner image fixing device comprising:

a first roller having a heater lamp provided therein;

a second roller coming into pressure contact with the first roller at a pressure contact portion;

a parting agent supplying unit adapted to supply a parting agent having a volatile odor component onto a surface of the first roller; and an auxiliary heating unit provided on at least one side of an upstream side and a downstream side in a recording material transporting direction in relation to the pressure contact portion, for heating a recording material having unfixed toner on a front surface thereof.

wherein a recording material having unfixed toner on a front surface thereof is heated and pressed at the pressure contact portion while being nipped and conveyed at the pressure contact portion, thereby fixing the unfixed toner onto the recording material; and a surface temperature of the first roller is set to a temperature at which the volatile odor component has no more than a permissible value.

2. The toner image fixing device according to claim 1, wherein the auxiliary heating unit heats a back surface of the recording material.

3. The toner image fixing device according to claim 1, wherein the auxiliary heating unit winds the recording material on the first roller by a predetermined distance from an end of the pressure contact portion.

4. The toner image fixing device according to claim 1, wherein the parting agent having a mercaptan denatured oil as a main component thereof.

5. A toner image fixing device comprising:

a first roller having a heater lamp provided therein;

a second roller coming into pressure contact with the first roller at a pressure contact portion;

a parting agent supplying unit adapted to supply a parting agent having a volatile odor component onto a surface of the first roller; and a first auxillary heating unit provided on an upstream side of a recording material transporting direction in relation to the pressure contact portion, for heating a back surface of the recording material having unfixed toner on a front surface thereof, a second auxiliary heating unit provided on a downstream side of the recording material transporting direction in relation to the pressure contact portion, for winding the recording material on the first roller by a predetermined distance from an end of the pressure contact portion, wherein the recording material having unfixed toner on a front surface thereof is heated and pressed at the pressure contact portion while being nipped and conveyed at the pressure contact portion, thereby fixing the unfixed toner onto the recording material: and a surface temperature of the first roller is set to a temperature at which the volatile odor component has no more than a permissible value.

6. The toner image fixing device according to claim 5, wherein the parting agent has a mercaptan denatured oil as a main component thereof.

* * * * *